US009119427B2

(12) United States Patent
Omer

(10) Patent No.: US 9,119,427 B2
(45) Date of Patent: Sep. 1, 2015

(54) SUPPORTING AND PROTECTING ARTICLE FOR THE HUMAN TORSO

(71) Applicant: Dotan Omer, Azur (IL)

(72) Inventor: Dotan Omer, Azur (IL)

( * ) Notice: Subject to any disclaimer, the term of this patent is extended or adjusted under 35 U.S.C. 154(b) by 0 days.

(21) Appl. No.: 14/349,035

(22) PCT Filed: Oct. 4, 2012

(86) PCT No.: PCT/IB2012/001965
§ 371 (c)(1),
(2) Date: Apr. 1, 2014

(87) PCT Pub. No.: WO2013/050859
PCT Pub. Date: Apr. 11, 2013

(65) Prior Publication Data

US 2014/0289939 A1 Oct. 2, 2014

Related U.S. Application Data

(60) Provisional application No. 61/542,968, filed on Oct. 4, 2011.

(51) Int. Cl.
*A41D 13/05* (2006.01)
*A41D 13/015* (2006.01)
*A63B 71/12* (2006.01)

(52) U.S. Cl.
CPC ..... *A41D 13/015* (2013.01); *A41D 13/0518* (2013.01); *A63B 71/12* (2013.01); *A63B 2071/1208* (2013.01)

(58) Field of Classification Search
CPC . A41D 13/015; A41D 13/0015; A41D 13/05; A41D 13/0518; A41D 7/00; A41D 13/012; A41D 13/0125; A63B 71/1208; A63B 71/12; A63B 69/0093; B63C 9/11; B63C 2011/046
USPC ..... 2/463, 464, 2.15, 455, 456, 67, 2.16, 2/2.17; 441/102, 106, 107; 482/55
See application file for complete search history.

(56) References Cited

U.S. PATENT DOCUMENTS

| | | | | | |
|---|---|---|---|---|---|
| 1,504,916 | A | * | 8/1924 | Teiber | 441/102 |
| D255,056 | S | * | 5/1980 | Parsons | D29/101.3 |
| 4,356,569 | A | * | 11/1982 | Sullivan | 2/2.5 |
| 4,397,636 | A | * | 8/1983 | Ganshaw | 441/65 |
| 4,441,211 | A | * | 4/1984 | Donzis | 2/459 |
| 4,872,215 | A | * | 10/1989 | Sliger | 2/463 |
| 5,015,208 | A | * | 5/1991 | Fox et al. | 441/55 |
| 5,435,765 | A | | 7/1995 | Fletcher | |

(Continued)

FOREIGN PATENT DOCUMENTS

| | | | |
|---|---|---|---|
| AU | 9129801 | A | 3/2002 |
| AU | 2005237133 | A1 | 6/2006 |

(Continued)

*Primary Examiner* — Amy Vanatta
(74) *Attorney, Agent, or Firm* — Hankin Patent Law, APC; Marc E. Hankin; Jimmy Sauz

(57) ABSTRACT

A piece of apparel or wearable equipment is provided for wave surfers. The purpose of the apparel is to distribute pressure on a surfer's chest during the 'paddling' operation, where the surfer lies belly down upon the surfboard and paddles out to sea. The apparel consists of a supporting article encircling the torso, having cushioning members embedded therein that absorb the pressure of the surfers body upon the board.

10 Claims, 21 Drawing Sheets

(56) References Cited

U.S. PATENT DOCUMENTS

| | | | | | |
|---|---|---|---|---|---|
| 5,459,874 | A * | 10/1995 | Meredith | 2/67 |
| 5,621,914 | A * | 4/1997 | Ramone et al. | 2/463 |
| D380,286 | S * | 7/1997 | O'Neill | D2/853 |
| D381,489 | S * | 7/1997 | O'Neill | D2/742 |
| 6,182,299 | B1 * | 2/2001 | Chen | 2/463 |
| 6,434,749 | B1 | 8/2002 | Grounds et al. | |
| 6,485,446 | B1 * | 11/2002 | Brother et al. | 602/20 |
| 7,252,625 | B1 | 8/2007 | Perka | |
| 7,867,050 | B2 | 1/2011 | Crispin | |
| 8,539,616 | B2 * | 9/2013 | BeLand et al. | 2/267 |
| 2002/0026664 | A1 | 3/2002 | Grounds et al. | |
| 2003/0167560 | A1 * | 9/2003 | LaShoto et al. | 2/463 |
| 2004/0221355 | A1 * | 11/2004 | Garcia | 2/67 |
| 2004/0231025 | A1 * | 11/2004 | Herman et al. | 2/67 |
| 2006/0073943 | A1 | 4/2006 | Perka | |
| 2009/0270001 | A1 | 10/2009 | Crispin | |
| 2009/0270002 | A1 | 10/2009 | Crispin | |
| 2012/0304369 | A1 * | 12/2012 | Carmichael | 2/464 |
| 2013/0239309 | A1 * | 9/2013 | Webb | 2/464 |

FOREIGN PATENT DOCUMENTS

| | | | |
|---|---|---|---|
| WO | WO0219853 | A2 | 3/2002 |
| WO | WO0219853 | A3 | 6/2002 |
| WO | WO2009134533 | A2 | 11/2009 |
| WO | WO2009134533 | A3 | 12/2009 |
| WO | WO2013050859 | A1 | 4/2013 |

* cited by examiner

SUPPORTING AND PROTECTING ARTICLE FOR THE HUMAN TORSO

CROSS-REFERENCE TO RELATED APPLICATIONS

This Application is a U.S. National Stage Utility Non-Provisional Patent Application to PCT Application No. PCT/IB2012/001965, filed on Oct. 4, 2012, by inventor and Applicant Dotan Omer, the contents of which are hereby expressly incorporated by this reference in their entirety, and to which priority is claimed. Priority is also claimed to U.S. Provisional Patent Application No. 61/542,968, filed on Oct. 4, 2011, by inventor and Applicant Dotan Omer, the contents of which are hereby expressly incorporated by this reference in their entirety.

BACKGROUND

1. Technical Field

The invention comprises a device for protecting wave surfers and a method of its use.

2. Description of Related Art

Surfers in 'paddling mode' lie prone on the surfboard as they paddle out to wave-bearing regions of water. During this operation considerable forces may be brought to bear upon the chest, ribs, sternum and other areas. To deal with such, wetsuits are sometimes used, which provide some measure of protection at the expense of the suit and some degree of freedom and comfort.

Hence, an improved method for paddling mode protection still a long felt need.

BRIEF SUMMARY

A piece of apparel or wearable equipment is provided for wave surfers. The purpose of the apparel is to prevent undue pressure on a surfer's chest during the 'paddling' operation, where the surfer lies belly down upon the surfboard and paddles out to sea. The apparel consists of a supporting article encircling the torso, having cushioning members embedded therein that absorb the pressure of the surfers body upon the board.

The present invention comprises an article designed for supporting and protecting a surfer's torso and ribs. The article comprises one or more pads having an appropriate ergonomic shape, adapted to be placed over the general region of the ribs. In one embodiment the pad(s) are placed approximately at the locations of the $4^{th}$-$8^{th}$ ribs. Generally the pad(s) are secured in place by mean of at least one preferably flexible band attached or enclosed to the pads. The band may in some embodiments surround the torso for the purpose of holding the pads in their position.

It is within provision of the invention to disclose an item of surfing gear comprising:

a. a supporting article that encircles the waist;
b. padding members enclosed within said supporting article;

wherein padding members prevent undue pressure upon a surfer's chest during paddling.

It is further within provision of the invention wherein said supporting article is comprised of materials selected from the group consisting of: neoprene, closed-cell neoprene, elastomer, rubber, caoutchouc, nylon, spandex, lycra, latex, carbon fiber.

It is further within provision of the invention wherein said padding members are comprised of materials selected from the group consisting of: neoprene, closed-cell neoprene, elastomer, rubber, caoutchouc, nylon, spandex, lycra, latex, carbon fiber, polyehtylene, polyurethane, foam rubber.

It is further within provision of the invention to provide with a belt allowing the item to be easily secured around the surfer's torso.

It is further within provision of the invention wherein said padding members are adapted to absorb shock and comply to compression, allowing the surfer to lie upon the surfboard without undue pressure upon the sternum.

It is further within provision of the invention wherein said padding members are further provided with protuberances adapted to create friction between said item and the surfboard.

It is further within provision of the invention that the invention may be attached to any kind of surfing top.

It is further within provision of the invention wherein said protuberances are comprised of material selected from the group consisting of: ABS plastic, neoprene, closed-cell neoprene, elastomer, rubber, caoutchouc, nylon, spandex, lycra, latex, carbon fiber, polyethylene, polyurethane, foam rubber.

It is further within provision of the invention wherein said protuberances are anchored 305 within said padding members.

It is further within provision of the invention wherein said padding members 302 are encased between front and back supporting article parts.

It is further within provision of the invention to disclose a method for protection of surfers during paddling comprising steps of:

a. providing an article of surfwear comprising:
   i. a supporting article that encircles the waist;
   ii. padding members enclosed within said supporting article;
b. wearing said article of surfwear while paddling prone, with chest upon surfboard;

wherein padding members prevent undue pressure upon a surfer's chest during paddling.

It is an object to provide one or more pad(s) or padding member(s) constructed of shock absorption material that are configured to help minimize the normal force and pressure applied against the user's chest during paddling. Specifically, the pad(s) or padding member(s) are generally configured to allow the user to contact the surfboard over a larger surface area, thereby helping distribute and alleviate the pressure resulting from the contact between body mass of the user and surfboard. Thus, the normal force and pressure applied against the chest of the user will generally be minimized.

It is an object to provide an additional highly frictional or rough layer located at the outside or top article of clothing. This layer is preferably configured as a friction enhancer layer that promotes a better grip between the user and surfboard.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

In order to understand the invention and to see how it may be implemented in practice, a plurality of embodiments will now be described, by way of non-limiting example only, with reference to the accompanying drawings, in which.

DETAILED DESCRIPTION

Figure 1:
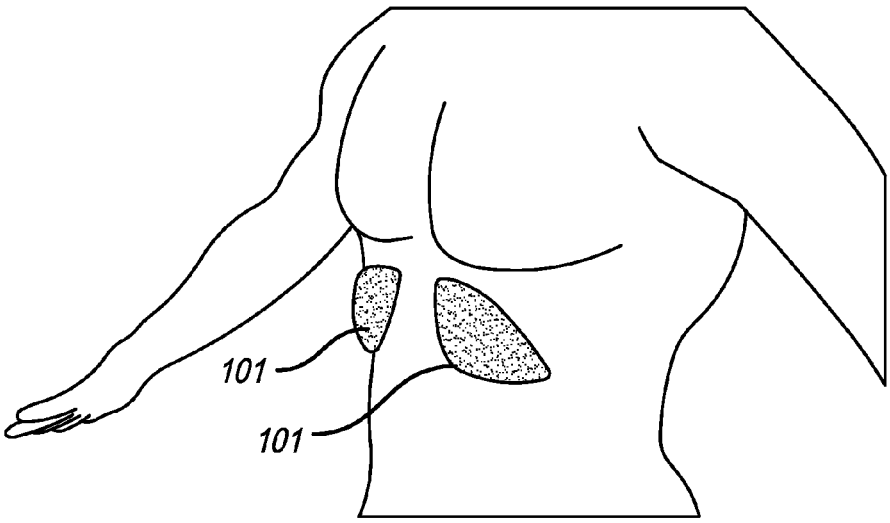
FIG. 1 illustrates protective pads according to an embodiments of the present invention.

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for providing a system and method of a surfing top.

In the following detailed description, numerous specific details are set forth in order to provide a thorough understanding of embodiments of the present invention. However, those skilled in the art will understand that such embodiments may be practiced without these specific details. To justly and entirely describe renditions of each embodiment may not yield full reportage of underlying concepts. Thus we must generally admit that not all embodiments are necessarily described herein, but that the concepts underlying the invention are themselves disclosed.

Reference throughout this specification to "one embodiment" or "an embodiment" means that a particular feature, structure, or characteristic described in connection with the embodiment is included in at least one embodiment of the invention.

The term 'plurality' refers hereinafter to any positive integer (e.g, 1, 5, or 10).

A piece of apparel or wearable equipment is provided for wave surfers. The purpose of the apparel is to prevent undue pressure on a surfer's chest during the 'paddling' operation, where the surfer lies belly down upon the surfboard and paddles out to sea. The apparel consists of a wetsuit-like supporting article encircling the torso, having cushioning members embedded therein that absorb the pressure of the surfers body upon the board.

The invention comprises a piece of apparel or wearable equipment for wave surfers, whose main object is to prevent undue pressure on a surfer's chest during the 'paddling' operation. This is an operation wherein the surfer lies belly down upon the surfboard and paddles out to sea. Often great force will be exerted upon the surfer's sternum and/or ribs in such a position, for example due to a rising wave. One description of this operation reads:

> "Paddling technique is one of the most important skills in surfing. You spend most of your time paddling around during your session . . . . Once you've got yourself lying at the right spot on your board, the next step is to arch your back a bit so your weight is on the bottom of your rib cage . . . . This position is HARD for the very new because of the muscles involved." [http://www.surfing-handbook.com/knowledge/beginners-surfing-tips/paddling-technique/]

As suggested above when the surfer lies upon the surfboard, it may be found that massive and continuous pressure is exerted upon the torso. This pressure may cause chafing and possibly injury to the chest and/or ribs, prompting some to quit surfing after their first lessons due to the uncomfortable sensations.

The present invention comes to remedy this situation by means of an article for protecting the torso and ribs, for example in one embodiment using a pair of identical pads 101 as seen in FIG. 1. A further supporting article (not seen in this illustration for purposes of clarity) is designed to hold these pads at specific locations chosen to protect the ribs, sternum, or other location(s). In some embodiments the exact placement of the pads may be variable, with the user being able to fix the position thereof by suitable means such as adjustable bands, straps, or the like as will be obvious to one skilled in the art.

The pads are in certain embodiments comprised of flexible, impact-resistant, waterproof material that is capable of absorbing the pressure applied on the torso while paddling as well as through the entire surfing session, thereby reducing the likelihood of rib injuries. The pads' size and mass are designed to resist the maximum pressure applied to the long-suffering surfer's torso.

Figure 2A:
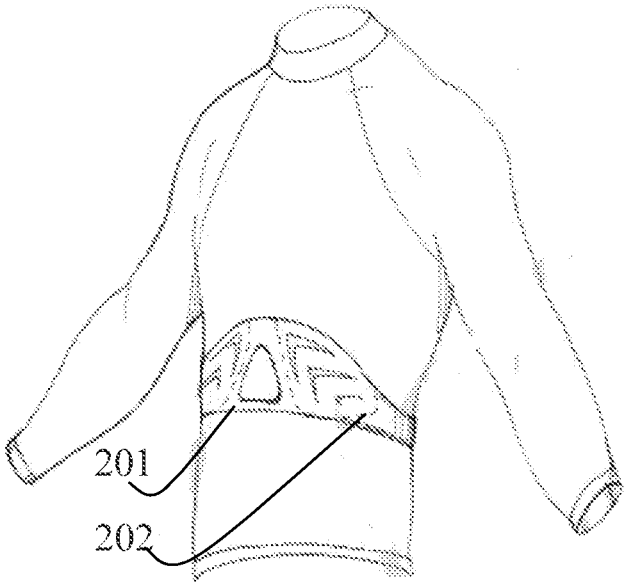
FIG. 2A illustrates a front view of the supporting vest according to an embodiment of the present invention.

FIG. 2A illustrates the front view of the supporting article according to some embodiments of the invention. The supporting article includes a supporting element 201 which includes the padding members such as those indicated in FIG. 1 embedded therein (visible in outline as dotted lines 202). The padding members 202 are preferably made of an elastic soft material, such as RTV gel. The gel is enclosed within the supporting element 201 at a predefined area which fits the shape of the torso at the edge of the rib cage or other desired area.

Figure 2B:
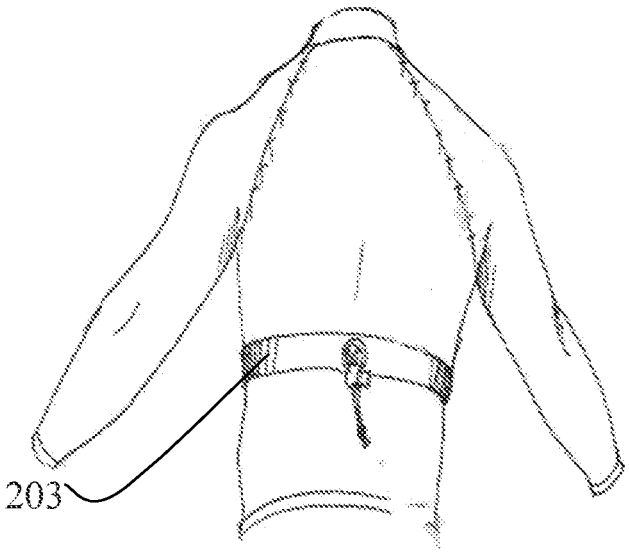
FIG. 2B illustrates a back view of the supporting article according to an embodiment of the present invention.

The supporting element 201 is attached to the torso by (for example) one or more rear bands 203 (see FIG. 2*b*) encircling the body with some degree of tension, and thus holding the pads in the desired position. The padding member area may cover just the edge of the ribs, requiring minimum space, or a larger area in some embodiments. Using a small pad allows use of the minimal mass required to protect the torso against applied pressure, which is useful as unnecessary extra mass will likely prove inconvenient for surfer.

Figure 3:
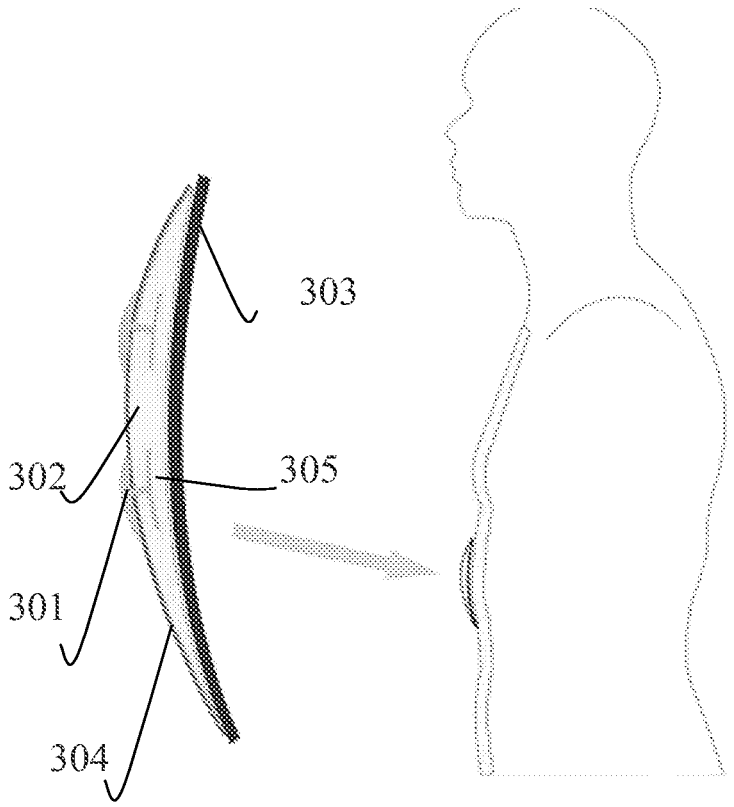
FIG. 3 illustrates a side view of the supporting article pad according to an embodiment of the present invention.

According to an embodiment consistent with the invention, the pad area may be larger than the minimal space required for covering the ribs edges. Likewise, the pads may have different thickness at certain areas (see FIG. 3 element 301). FIG. 3 illustrates a side view of a possible embodiment of padding member 302, enclosed within front and rear supporting members 304,303 respectively. These members 303,304 may comprise materials such as rubber or Neoprene. Certain materials are preferable for contact with skin (e.g. for members 303) while others may be preferred for contact with the board (e.g. Lycra for member 304).

The pads' width can be thicker at the center or in general may be of nonuniform thickness. This will aid in several respects, for example allowing use of a minimum practicable mass of pad material necessary for protecting the ribs against injuries resultant from a given pressure level. The supporting element 303 or pads themselves 302 may contain protruding elements 301 which are designed for improving the contact with surfing board, supporting the surfer to balance his body when lying on the surfing board. According to some embodiments of the present invention the protrusions 301 may be integrated within the pad, through an insert 305 which is enclosed within the pad material as shown.

As seen in this example the supporting element 303 may support the pad 302 which is held from the back by the supporting element 303, or may be contained therein as in FIG. 2*a*.

Figure 4:
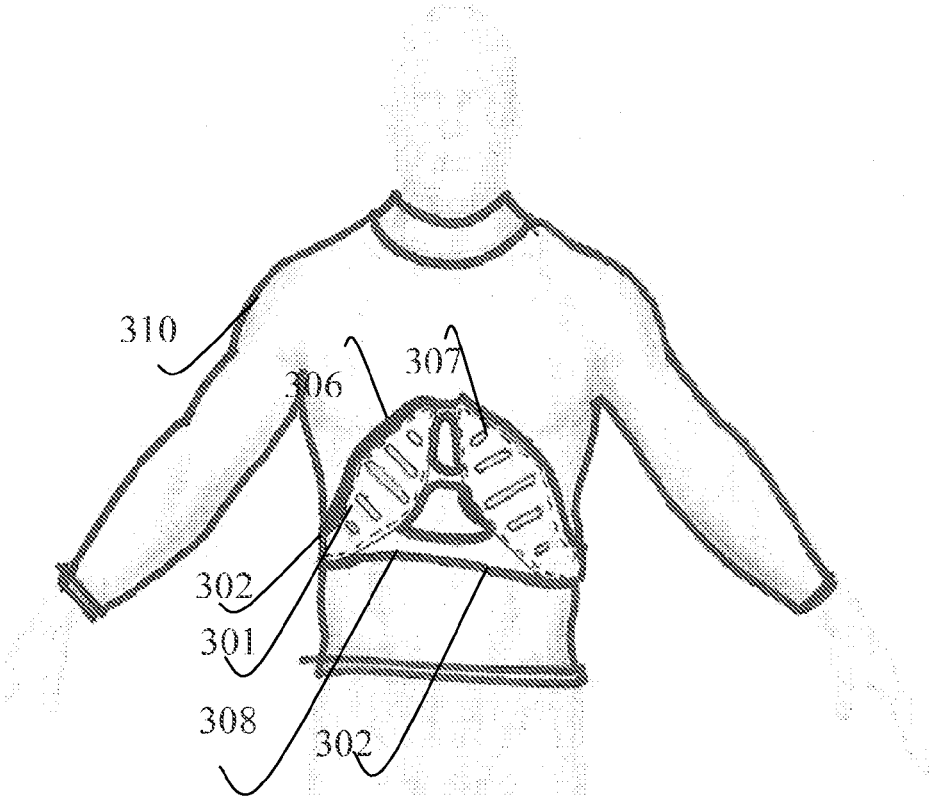
FIG. 4 illustrates a front view of the supporting pads integrated with a surfing suit according to an embodiment of the present invention.
Figure 5:
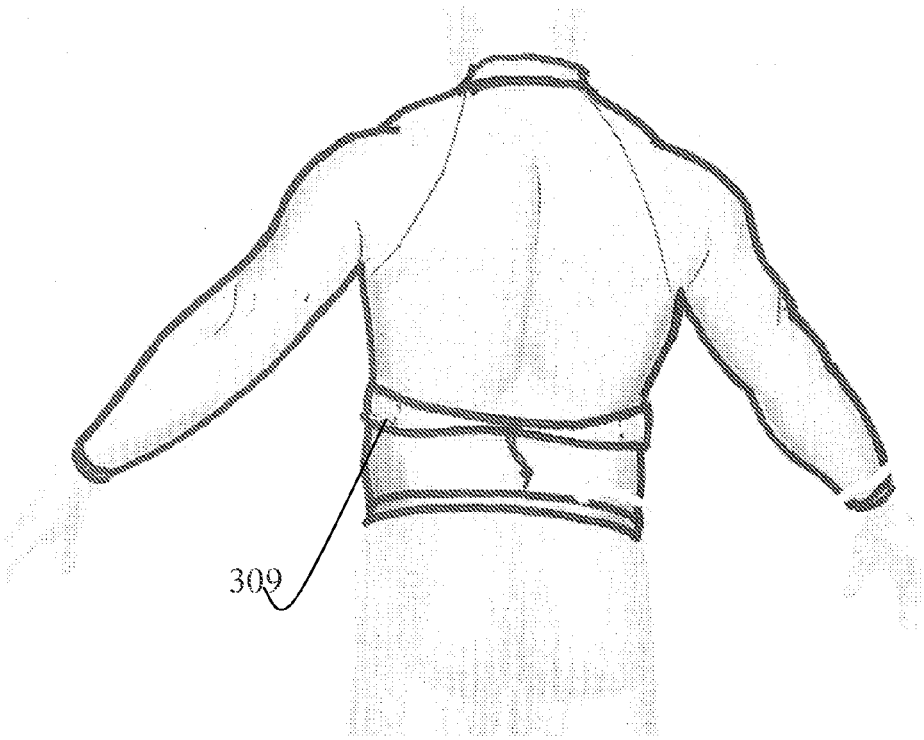
FIG. 5 illustrates a back view of the supporting article according to an embodiment of the present invention.

The supporting article according to the present invention may be used as standalone product or integrated within a surfing suit 310 or wetsuit as delineated in FIG. 4. This figure illustrates the supporting article structure according to some embodiments of the present invention. The supporting article in this particular embodiment is comprised of two halves 306 and 307, each enclosing padding members 302 (indicated by dotted lines, as they are enclosed within the supporting members 306,307 and hence not visible.) The supporting members are integrated by front elastic bands 308 and a rear elastic band 309 which surrounds the torso as seen in FIG. 5. The supporting article may further include rubber protrusions or other elements designed to create a desired interaction with the surfing board such as grip, impact resistance, cushioning, or the like.

Figure 6:
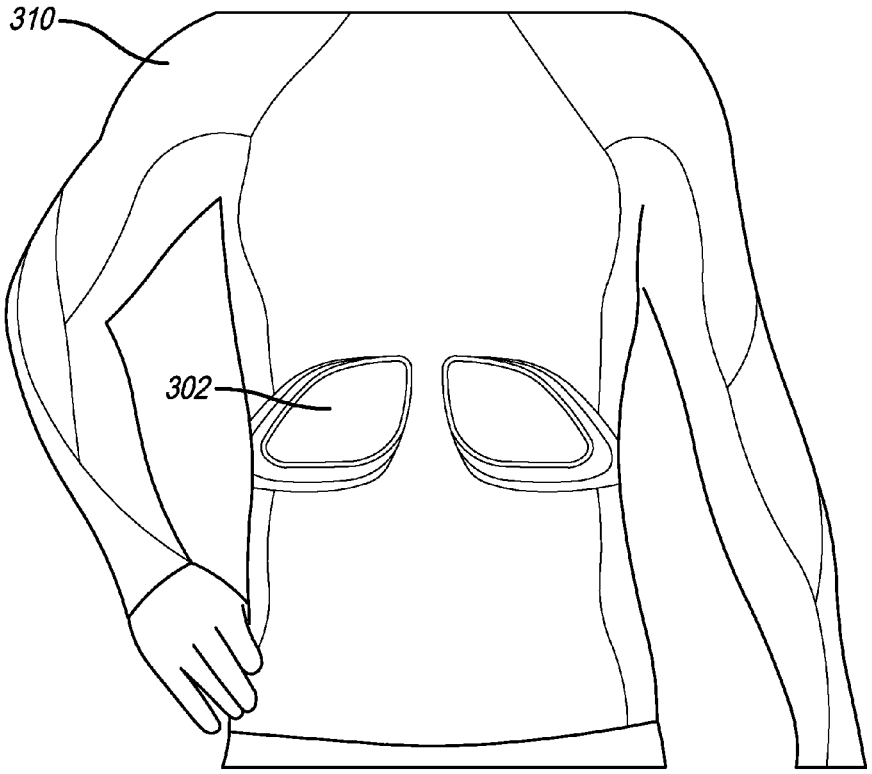
FIG. 6 illustrates the pads integrated a surfing suit within according to some embodiments of the present invention.

FIG. 6 shows one view of one possible embodiment of the invention in which padding members 302 are visible (in an 'x-ray' view) underneath a standard wetsuit top 310.

Figure 7:
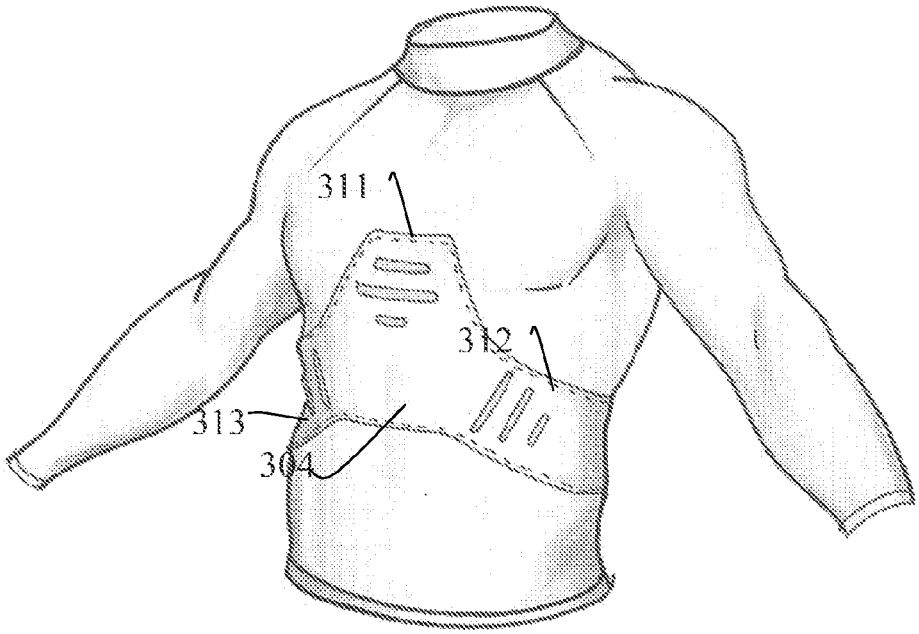
FIG. 7 illustrates a front view of the supporting article according to other embodiments of the present invention.
Figure 8:
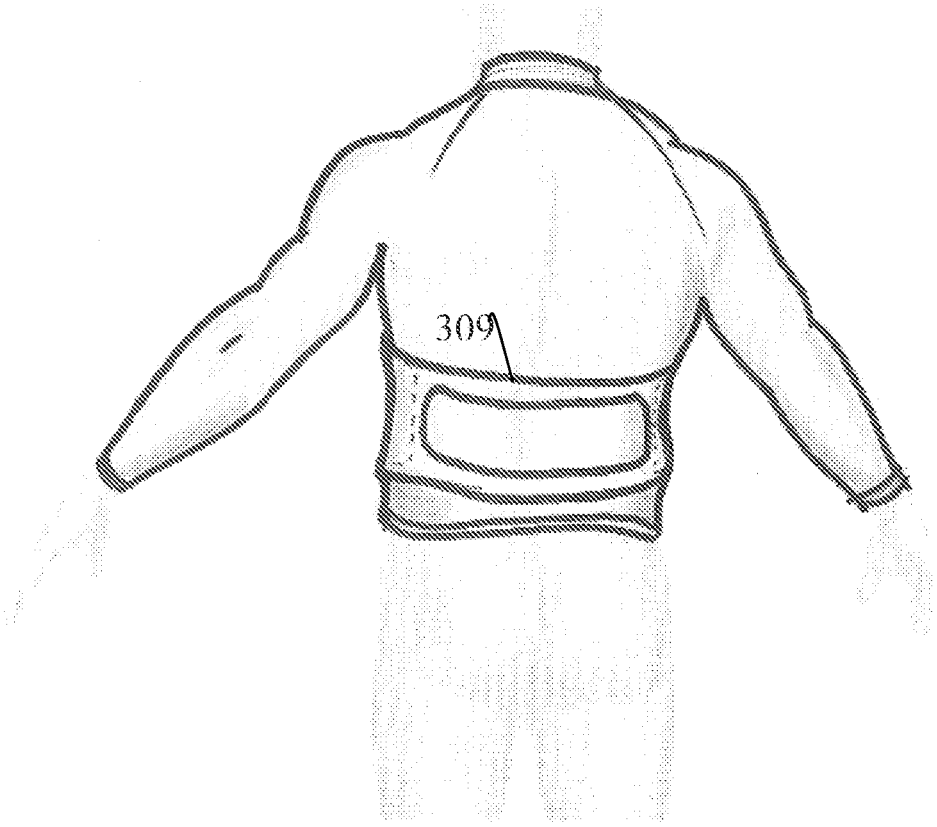
FIG. 8 illustrates a back view of the supporting article according to other embodiments of the present invention.

FIG. 7 illustrates the supporting article structure according to a possible embodiment of the present invention. The supporting article 304 is comprised of three supporting elements, an upper element 311 and side elements 313, 312, each enclosing padding members as before. The side supporting elements are connected by a rear elastic band 309 which surrounds the torso as seen in FIG. 8. The supporting article may further include rubber elements as before to allow for increased friction, abrasion resistance, etc. between the article and the surfboard.

Figure 9:
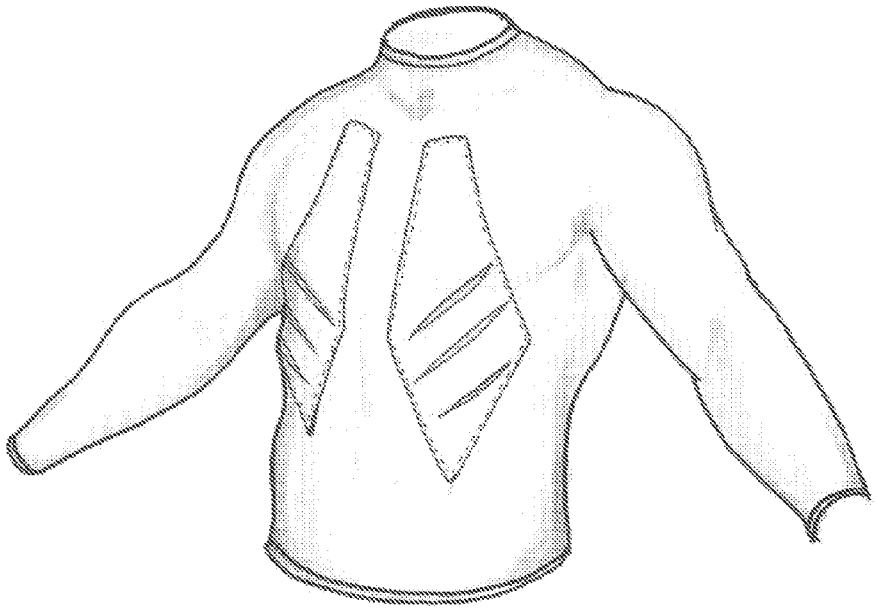
FIG. 9 illustrates a front view of the supporting article according to other embodiments of the present invention.
Figure 10A:
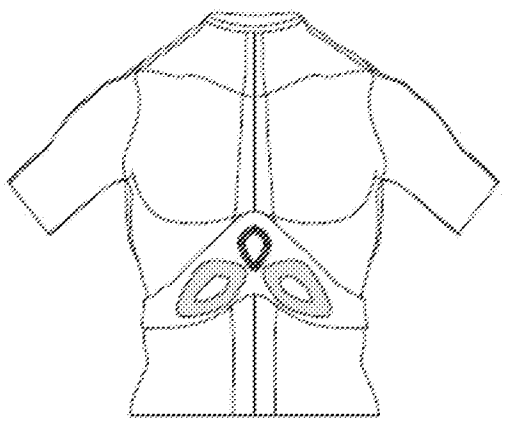
FIGS. 10A-D illustrate front and cross sectional views of the supporting article having internal cutout shape according to other embodiments of the present invention.
Figure 10B:
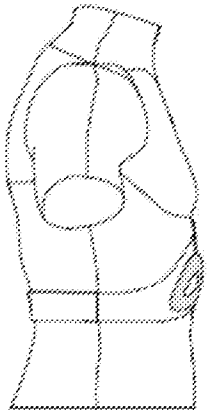
Figure 10C:
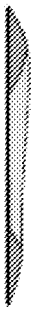
Figure 10D:
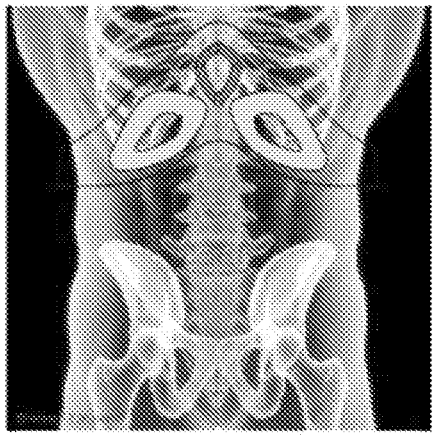
Figure 10E:
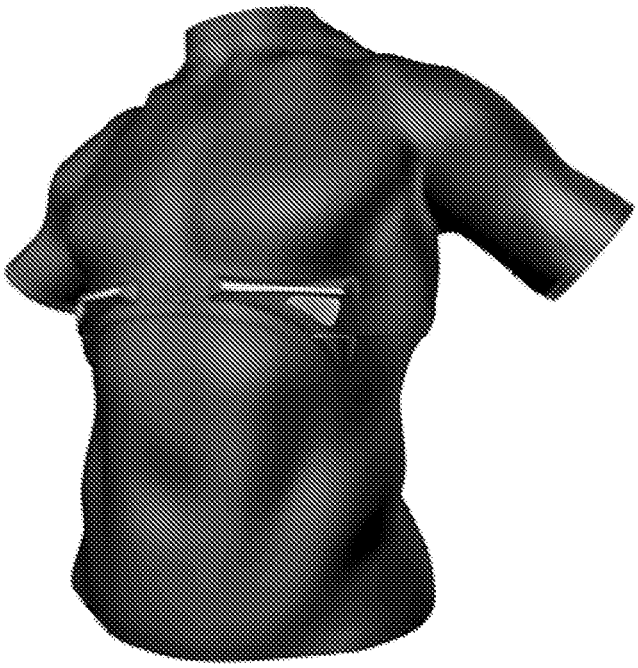
FIG. 10E illustrate perspective view of the supporting article according to other embodiments of the present invention.
Figure 11A:
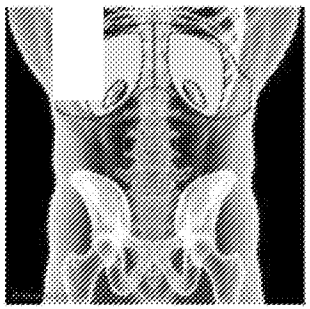
FIGS. 11A-D illustrate a front and cross sectional views of the supporting article having internal cutout shape at the lower portion according to other embodiments of the present invention.
Figure 11B:
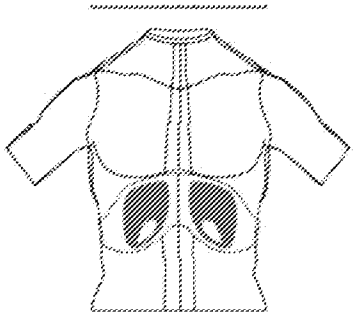
Figure 11C:
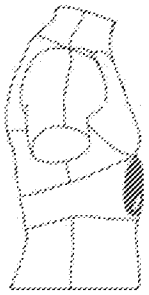
Figure 11D:
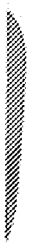
Figures 12A, 12B, 12C, 12D:
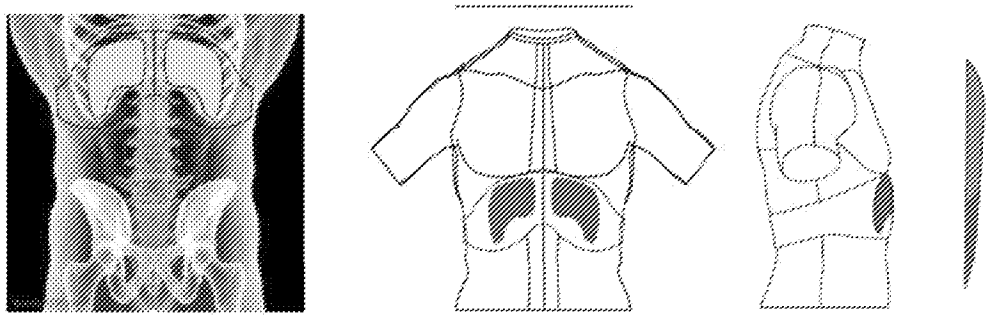
FIGS. 12A-D illustrate front and cross sectional views of the supporting article having designated shape for supporting upper bones of the torso according to other embodiments of the present invention.
Figure 13A:
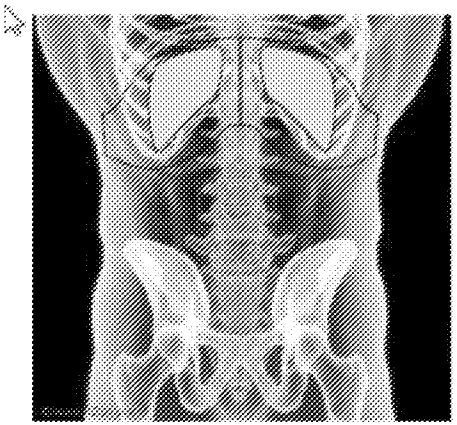
FIGS. 13A-D illustrate front and cross sectional views of the supporting article having designated shape for supporting upper bones of the torso according to other embodiments of the present invention.
Figure 13B:
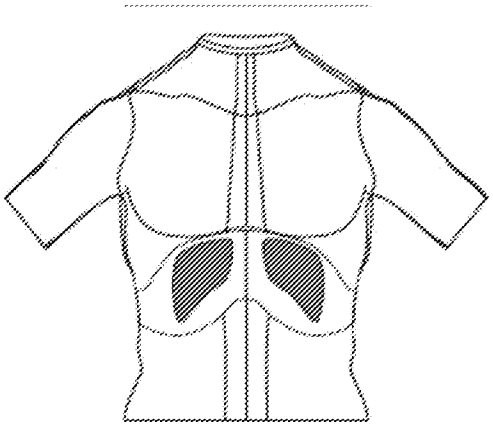
Figure 13C:
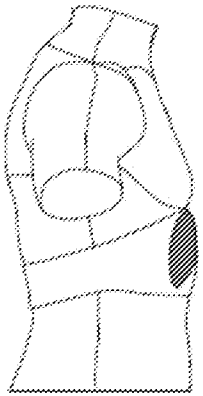
Figure 13D:
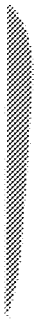

FIG. 9 illustrates another possible embodiment of the present invention. According to this embodiment the article is designed from two supporting elements, stretched from the upper part of the torso till from the lower part at the edge of the rib cage. This design provides extended support for the surfer torso and ribs. Each supporting element encloses padding members. The supporting elements may further include protruding rubber elements as detailed above.

FIGS. 10A-D illustrate front and cross sectional views of the supporting article having internal cutouts, according to other embodiments of the present invention. According to these embodiments the supporting article is designed with an internal cutout for protecting only part of the torso bones which are more exposed during the surfing and have more potential for injury.

FIGS. 11A-D illustrate front and cross sectional views of the supporting articles having as internal cutout shape at the lower portion according to other embodiments of the present invention. According to this embodiment the supporting article is designed with an internal cutout at the lower part of the torso, excluding the first bones of the torso (which are not exposed during surfing).

FIGS. 12A-D illustrate a front and cross sectional views of the supporting article having designated shape for supporting upper bones of the torso according to other embodiments of the present invention. According to this embodiment the supporting article is designed to protecting only the upper part of the torso bones which are more exposed during the surfing and have more potential for injury excluding the first bones of the torso which are not exposed during the surfing.

FIGS. 13A-D illustrate front and cross sectional views of an embodiment wherein the supporting article has a shape designed for support of the upper bones of the torso. According to this embodiment the supporting article is designed to protect only the upper part of the torso bones which are more exposed during the surfing and have more potential for injury excluding the first bones of the torso which are not exposed during the surfing.

Figure 14B:
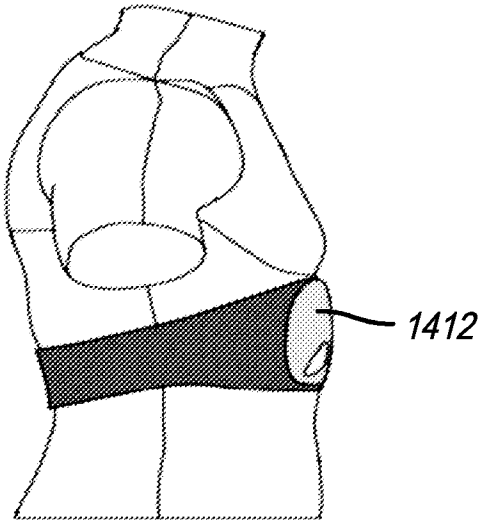
FIGS. 14A-B illustrate obverse and cross sectional views of the supporting article integrated with a belt for supporting upper bones of the torso according to other embodiments of the present invention.
Figure 14A:
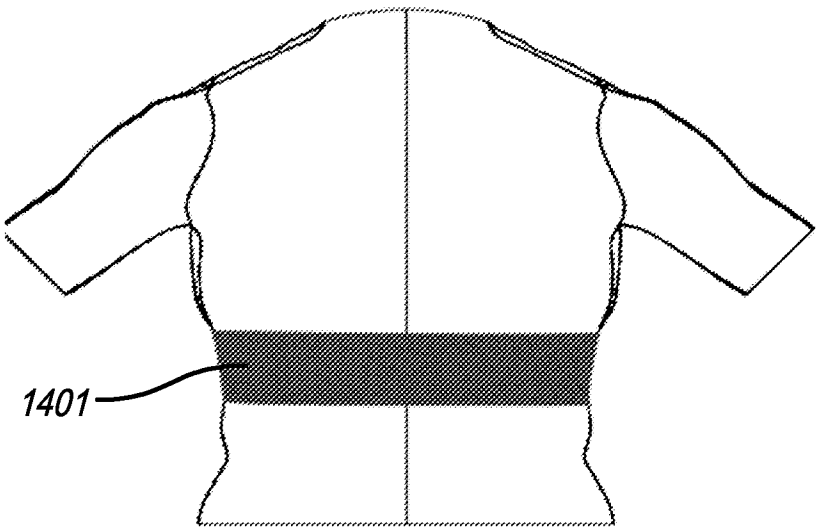

FIGS. 14A-B illustrate obverse and side views of the supporting article, integrated with a belt 1401 for supporting the upper bones of the torso according to certain embodiments of the invention. According to this embodiment the belt 1401 which is associated with supporting article is made of an elastomer such as Neoprene, while the pads 1412 may be made partially of silicon gel and partially of inflexible material, such as carbon fiber.

Figure 15B:
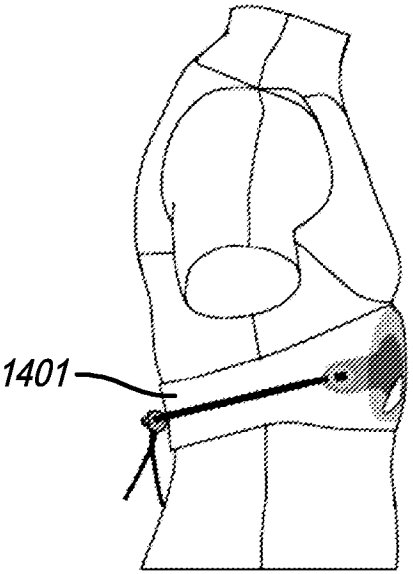
FIGS. 15A-B illustrates obverse and cross sectional views of the supporting article integrated with a belt for supporting upper bones of the torso according to other embodiments of the present invention.
Figure 15A:
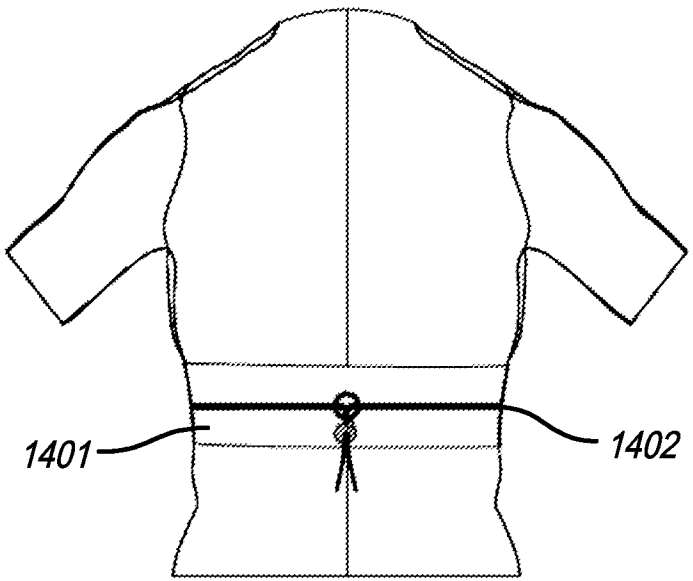

FIGS. 15A-B illustrate back and cross sectional views of the supporting article integrated with a belt 1401 for supporting upper bones of the torso according to other embodiments of the present invention. According to this embodiment the belt 1401 which is associated with supporting article includes a cord 1402 for tightening and adjusting the belt with respect to the user's torso.

Figure 16C:
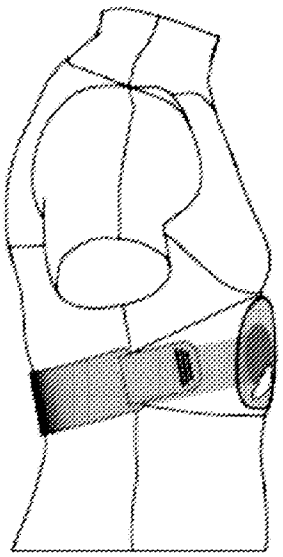
FIGS. 16A-C illustrates obverse and cross sectional views in open and close position of the supporting article integrated with a belt for supporting upper bones of the torso according to other embodiments of the present invention.
Figure 16B:
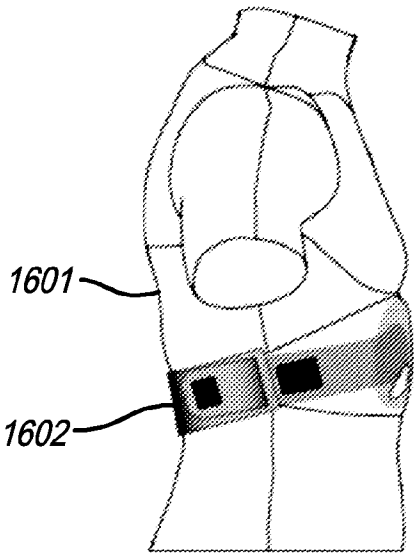
Figure 16A:
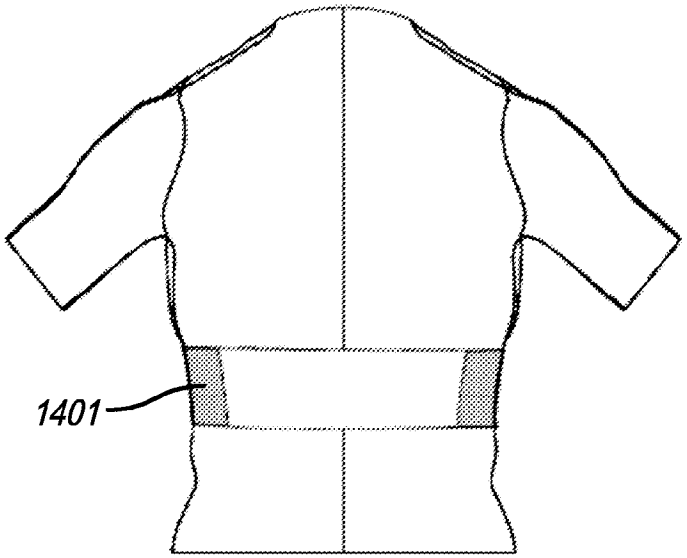

FIGS. 16A-C illustrates back and side views, in opened and closed positions of the supporting article, which in these embodiments is integrated with a belt for supporting upper bones of the torso. The belt 1401, which is associated with the supporting article 1601 includes a closure element 1602 for tightening and adjusting the belt to the user torso.

According to some embodiments of the present invention the supporting article is comprised of flexible material at the area connecting between the pads, enabling the user to adjust the location of the pads according to the size of the specific surfer. The adjustment is controlled by the changing the belt position.

Figure 17B:
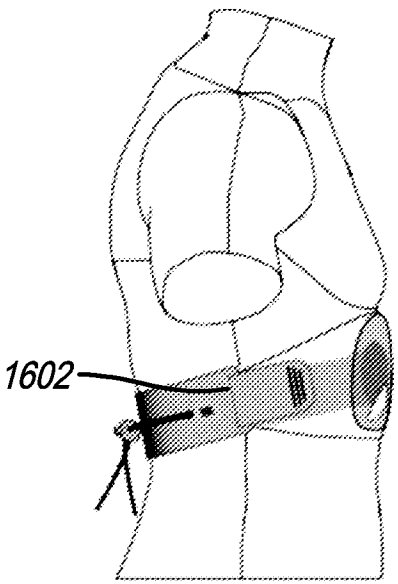
FIGS. 17A-B illustrates obverse and cross sectional views of the supporting article integrated with a belt for supporting upper bones of the torso according to other embodiments of the present invention.
Figure 17A:
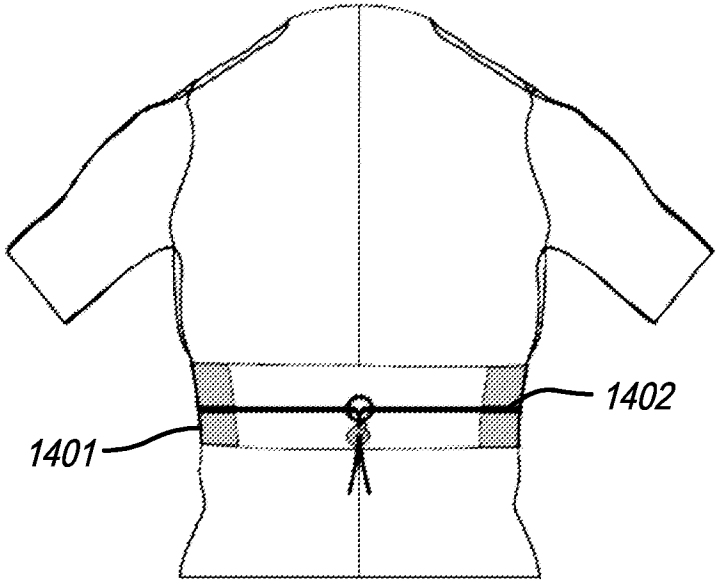
Figure 18A:
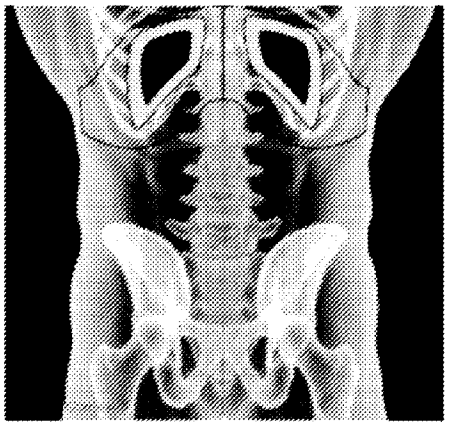
FIGS. 18A-D illustrates a front and cross sectional views of the supporting article having designated shape for supporting upper bones of the torso according to other embodiments of the present invention.
Figure 18B:
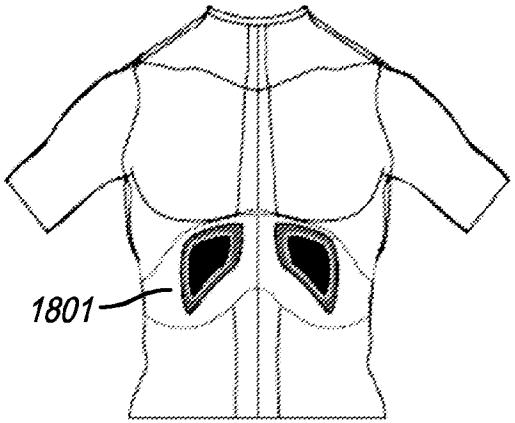
Figure 18C:
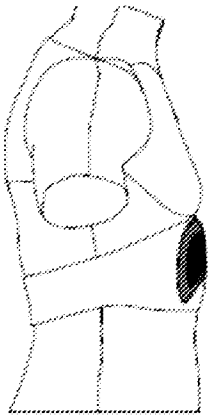
Figure 18D:
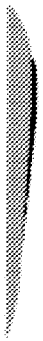
Figure 19A:
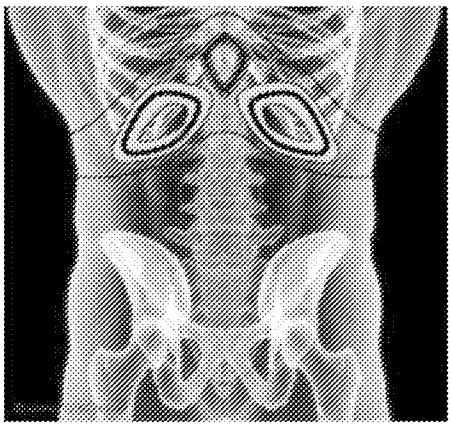
FIGS. 19A-D illustrates a front and cross sectional views of the supporting article having designated shape for supporting upper bones of the torso according to other embodiments of the present invention.
Figure 19B:
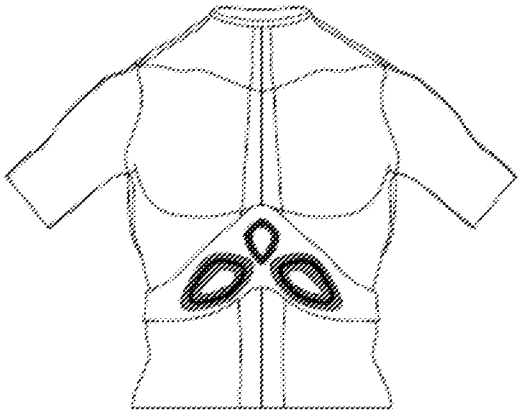
Figure 19C:
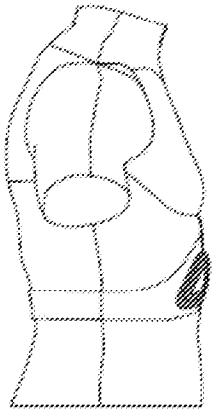
Figure 19D:
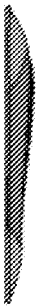

FIGS. 17A-B illustrate back and side views of the supporting article integrated with a belt for supporting upper bones of the torso. The belt 1401 in this embodiment includes a cord 1402 and closure element 1602 for tightening and adjusting the belt to the user torso. According to this embodiment the supporting article is designed to protect only the upper part of the torso, which is most exposed during surfing and thus has more potential for injury during paddling.

FIGS. 18A-D illustrate front and side views of the supporting article having a shape designed for supporting the upper bones of the torso according to other embodiments of the present invention. In this embodiment the supporting articles includes an additional rough layer 1801 for preventing slipping over the surfing board.

FIGS. 19A-D illustrate front and side views of the supporting article having a shape designed for supporting the upper bones of the torso according to other embodiments of the present invention. In this embodiment the supporting articles include an additional highly frictional or rough layer for preventing the surfer from sliding upon the surfing board.

It is within provision of the invention that pockets be provided in the supporting article, allowing the user to bring along small items such as keys, waterproof cameras, credit cards, business cards, money clips, cigarette cases, knives, and the like.

It is within provision of the invention that various weights be embedded within the supporting article, allowing it to be endowed with a mass enabling the surfers to bear down upon the board with greater force. This may prove of value for small surfers who are otherwise easily thrown from the board.

It is within provision of the invention that layers of strong material be embedded in the supporting article, for example carbon fiber or lexan sheets. These may in some embodiments enable the surfer to sustain otherwise fatal events such as body blows, shark attacks, propeller contusions, assassins' knives, the deadly spike of the manta-ray, and the like.

It is within provision of the invention that it may be fixed in place or anchored by various means that will be clear to one skilled in the art, such that it not move in undesired directions.

Features of certain embodiments consistent with the invention include but are not limited to:

a. minimal thickness for ease of use
b. anatomical design in accordance to the structure of the rib cage
c. a predetermined friction coefficient to prevent slipping on certain sections such as the front section contacting the surfboard In some embodiments consistent with the invention the device comprises a neoprene layer facing the body which is of high friction coefficient or stickiness. The neoprene band in the back area is sewn by a fabric layer that is not stretchable, allowing for them to be used for pulling other sections of the garment.

The silicon elements mentioned above may be fixed in predetermined places, as the silicon is trapped between the neoprene and lycra layers. In certain embodiments the upper part begins at a height of 2 millimeters, reaching a maximum of 7 millimeters. Between the silicon and neoprene layers there is an unstretchable fabric strip connected by glue or the like to the silicon only allowing the silicon to travel in a linear lengthwise fashion.

Adjusting members are provided in certain embodiments of the invention. These consist of fabric that is resistant to stretching and which can therefore be pulled to transmit tension to members to which they are attached. Strips of such fabric may for instance project out of the shirt on each side of the body after passing through the buckle. This may be made of hardened silicon that is still somewhat flexible, with a core that strengthens the buckle. The outer part of the adjustment members which come into contact with the surfboard may comprise lycra and upon them may be attached (for instance by means of hot gluing) means for increasing friction between surfboard and suit, such as the material used for the knees in surfing suits.

The adjustment members may be attached by means of hook-and-loop members to an indentation on the outer sides of the silicon members which will prevent the adjustment members from jutting out of the suit or causing height changes therein. The buckles which may attach the back and front adjustment members is hidden under the lycra and only its exit point is exposed.

Another embodiment of the invention may comprise a stickiness layer, a neoprene layer, one or more padding members, a lycra layer, and an outside layer. The neoprene layer generally contains the stickiness layer or sticky material located at the inner side of the neoprene and is generally configured to be applied directly to the user's or surfer's body to ensure that the neoprene layer will not shift during surfing activity. At the outer side of the neoprene layer may be one or more padding members configured to spread the pressure applied towards critical points of the user and is generally constructed of a thin layer of silicon. The lycra layer may be used to cover the padding members and neoprene layer and may also help keep the neoprene layer in place. The lycra layer may further comprise an outside layer that includes gripping material for enhanced friction between the user and surfboard.

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

What is claimed is:

1. A surfing gear apparel comprising:

a. a top apparel; and b. at least one supporting article;

wherein said top apparel and said at least one supporting article are configured to be worn around a torso of a user;

wherein said at least one supporting article comprises: a neoprene layer, a plurality of padding members, one or more adjustment straps, and an outside layer;

wherein said outside layer is configured to increase a friction between said user and said surfboard;

wherein said neoprene layer is configured to be applied directly to said torso of said user for enhanced gripping and to prevent said at least one supporting article from shifting when said user is performing a surfing activity;

wherein said neoprene layer is configured to be positioned between said torso of said user and said plurality of padding members when said surfing gear apparel is worn by said user;

wherein said plurality of padding members are constructed of a shock absorbing material and are positioned between said neoprene layer and said top apparel and wherein said plurality of padding members is configured to absorb shock and prevent undue pressure upon a user's torso when said user is lying on a surfboard;

wherein said top apparel comprises an outer side;

wherein said outside layer is positioned at said outer side of said top apparel and is configured to contact a surfboard when said user is lying on said surfboard;

wherein said outside layer is constructed of a friction enhancer layer configured to increase a friction between said user and said surfboard; and wherein said one or more adjustment straps are configured to reposition, secure, and adapt said plurality of padding members on said torso of said user;

wherein said one or more adjustment straps allow the plurality of padding members to be placed over a desired region of said torso of said user.

2. The surfing gear apparel of claim 1, wherein said at least one supporting article is comprised of one or more materials selected from the group of materials consisting of: neoprene, closed-cell neoprene, elastomer, rubber, caoutchouc, nylon, spandex, polyurethane, latex, gel, silicon RTV, and carbon fiber.

3. The surfing gear apparel of claim 1, wherein said plurality of padding members are comprised of one or more materials selected from the group of materials consisting of: neoprene, closed-cell neoprene, elastomer, rubber, caoutchouc, nylon, spandex, polyurethane, latex, carbon fiber, polyethylene, polyurethane, gel, silicon RTV, and foam rubber.

4. The surfing gear apparel of claim 1, wherein said one or more adjustment straps comprise a belt;

wherein said belt comprises a drawstring configured to adjust said belt; and wherein said belt allows said surfing gear apparel to be easily secured around the user's torso.

5. The surfing gear apparel of claim 1, wherein said plurality of padding members are adapted to absorb shock and comply to compression, allowing the user to lie upon said surfboard without undue pressure upon a desired protection area of a ribcage of said user.

6. The surfing gear apparel of claim 1, wherein said plurality of padding members further, comprise one or more protuberances;

wherein said one or more protuberances are configured to create friction between said surfing gear apparel and said surfboard.

7. The surfing gear apparel of claim 6, wherein said one or more protuberances are, comprised of one or more materials selected from the group of materials consisting of: ABS plastic, neoprene, closed-cell neoprene, elastomer, rubber, caoutchouc, nylon, spandex, polyurethane, latex, carbon fiber, polyethylene, polyurethane, and foam rubber.

8. The surfing gear apparel of claim 6, wherein said one or more protuberances are anchored within said plurality of padding members.

9. The surfing gear apparel of claim 1, wherein said padding members are encased between a front supporting article part and a back supporting article part.

10. The surfing gear apparel of claim 1, wherein said plurality of padding members are positioned approximately at the fourth to eighth ribs of said user.

* * * * *